United States Patent [19]

Peters

[11] Patent Number: 4,461,931

[45] Date of Patent: Jul. 24, 1984

[54] FREQUENCY RESPONSE EQUALIZING NETWORK FOR AN ELECTROSTATIC LOUDSPEAKER

[76] Inventor: Bernardus G. Peters, No. 6 Adelbrechtbaarde, 7329 AT Apeldoorn, Netherlands

[21] Appl. No.: 390,649

[22] Filed: Jun. 21, 1982

[30] Foreign Application Priority Data

Jun. 26, 1981 [NL] Netherlands ..... 8103095

[51] Int. Cl.[3] ..... H04R 19/00; H04R 19/02

[52] U.S. Cl. ..... 179/111 R; 381/103

[58] Field of Search ..... 179/111 R, 111 E, 1 D; 333/28 T; 323/340, 315; 381/98, 99, 100, 101, 92, 103

[56] References Cited

U.S. PATENT DOCUMENTS

| | | | |
|---|---|---|---|
| 1,836,266 | 12/1931 | McClintock | 179/111 R |
| 1,930,518 | 10/1933 | High | 179/111 R |
| 2,093,248 | 9/1937 | Oura | 179/1 D |
| 2,325,899 | 8/1943 | Young et al. | 323/340 |
| 2,993,090 | 7/1961 | Hupert et al. | 179/111 R |
| 4,237,340 | 12/1980 | Klipsch | 179/1 D |

FOREIGN PATENT DOCUMENTS

| | | |
|---|---|---|
| 2824866 | 1/1979 | Fed. Rep. of Germany . |
| 1091147 | 4/1955 | France . |
| 1366527 | 6/1964 | France . |

OTHER PUBLICATIONS

"Telstar Shaped Electrostatic Speaker", by R. J. Matthys, *Audio*, vol. 48, May 1964, pp. 19–24 and 73.

*Primary Examiner*—A. D. Pellinen
*Assistant Examiner*—Danita R. Byrd
*Attorney, Agent, or Firm*—Diller, Ramik & Wight

[57] ABSTRACT

An electrostatic loudspeaker system includes a transformer whose secondary winding is connected to the conductive plates of an electrostatic loudspeaker and whose primary winding is energized by an audio input signal through a frequency response equalizing network which includes an autotransformer winding as well as resistive and capacitive elements. Specifically, the autotransformer winding is connected in parallel with the primary winding, one audio input terminal is directly connected to one end of the autotransformer winding, at least one tap of the autotransformer winding is connected through a resistive element to the other audio input terminal and the other end of the autotransformer winding is connected to the other audio input terminal through a capacitive element.

23 Claims, 10 Drawing Figures

FIG. 1a
PRIOR ART
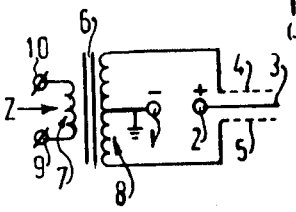
FIG. 1b
PRIOR ART
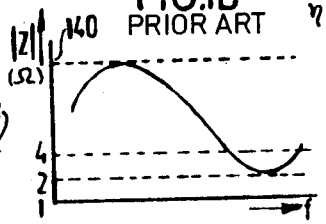
FIG. 1c
PRIOR ART
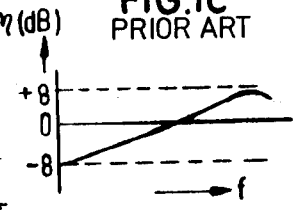
FIG. 2a PRIOR ART
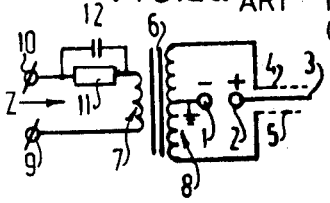
FIG. 2b
PRIOR ART
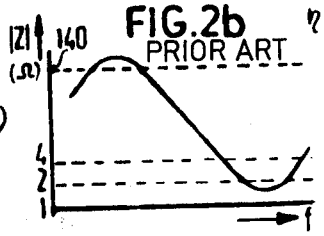
FIG. 2c
PRIOR ART
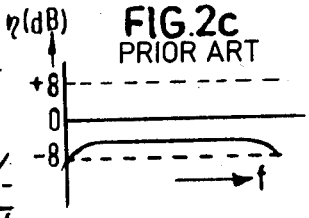
FIG. 3a
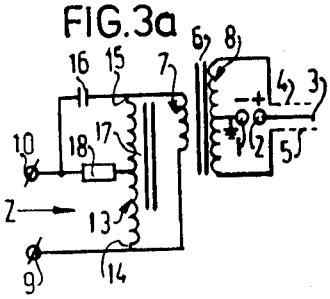
FIG. 3b
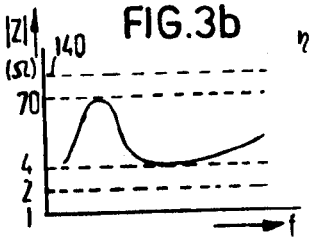
FIG. 3c
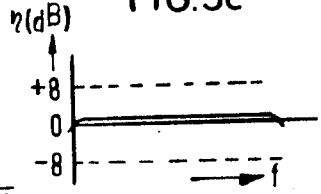
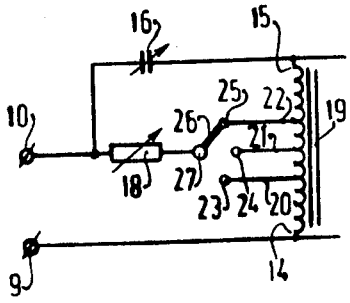
FIG. 4

FREQUENCY RESPONSE EQUALIZING NETWORK FOR AN ELECTROSTATIC LOUDSPEAKER

BACKGROUND OF THE INVENTION

The invention relates to an electrostatic loudspeaker comprising an electrically polarised or polarisable diaphragm arranged between two perforated, electrically conductive plates, to which an audio signal can be applied through two input terminals and comprising a frequency-response equalizing network comprising a resistor and a capacitor. Such a loudspeaker using either a diaphragm of electret foil or a diaphragm polarised by an external direct voltage for the conversion of electric audio signals into sound is known.

For a good understanding of the problems involved in the prior art and of the steps proposed by this invention to solve them first a survey of the known technology will be given.

An electrostatic loudspeaker is of the capacitative type. The capacity of a conventional, commercial system may be of the order of 2400 pF. Due to this low capacity the loudspeaker is of very high impedance. The impedance is a pure reactance which decreases with increasing frequency. In order to connect an electrostatic loudspeaker to a conventional low-ohmic amplifier a matching transformer is required. Such a transformer is usually termed a "step-up transformer", which serves to ensure that the low-ohmic amplifier finds a fairly low impedance.

Because of the frequency-dependent decrease in impedance, correct matching is in practice only possible in the range of the highest frequencies to be reproduced. It has, therefore, been proposed to split up an electrostatic loudspeaker into a plurality of systems, each of which matches the correct impedance for the highest frequencies to be reproduced thereby. By such a system reasonable efficiency can be obtained.

In practice it is found that splitting up into frequency bands brings about very serious problems because of which such relatively complicated systems do not provide the subjectively satisfying results aimed at. A solution proposed earlier, in which only one diaphragm serves to reproduce the complete frequency spectrum resides in the use of a frequency-response equalizing network comprising a parallel combination of a resistor and a capacitor, said network being included in one of the supply leads of the loudspeaker. However, the result of using such a frequency-response equalizing network is that the efficiency becomes very low. This known solution furthermore involves the great disadvantage that the absolute value of the impedance, which for all that, cannot be processed by most amplifiers without problems at the highest frequencies, drops even further. It is noted here that the absolute value of the impedance at the low-frequency system resonance in the known systems both with and without equalizing network is so high that amplifiers of some types, for example, the known very high-quality tube amplifiers, will suffer from serious mismatching, which results in deterioration of quality, whilst in addition technical problems are imminent.

Classical dynamic loudspeakers, in which, for example, a conical diaphragm is caused to vibrate by an electromagnetic driving system, are not subject to the above-described problems involved in electrostatic reproducers. However, the reproduction quality of electrostatic loudspeakers is widely considered to be appreciably better than that obtainable by electro-dynamic systems, whilst in addition electrostatic systems can provide a considerably larger dynamic range than the conventional electro-dynamic systems. The advantage of dynamic systems, however, is the materially higher efficiency.

BRIEF SUMMARY OF THE INVENTION

With regard to the foregoing, the invention has for its object to construct an electrostatic loudspeaker in a manner such that the efficiency is considerably raised to the same order of magnitude as that of electro-dynamic reproduction systems.

A further object of the invention is to design an electrostatic loudspeaker so that the absolute value of the impedance is limited within a smaller range. Finally, the invention has for its object to provide an electrostatic loudspeaker system in which the frequency response can, within given limits, be adapted to individual needs without the need for using complicated and expensive means.

For solving all problems and limitations of the prior art an electrostatic loudspeaker according to the invention as defined in the preamble is provided with an auto-transformer, in which one end terminal is directly connected to one audio input signal connection, the other end terminal is connected through a capacitor to the other audio input signal connection and the tapping is connected through resistor to the other audio input signal connection. Since the auto-transformer is operative only for low frequencies, it may be relatively simple and cheap.

The known frequency-response equalizing network has a time constant corresponding to a transition frequency in the low tone range, that is to say, of the order of magnitude of some tens up to 200 Hz. According to the invention, it is preferred for the resistor and the capacitor to have in common a time constant of the order of magnitude of 40 $\mu$S corresponding to a transition frequency of the order of 4 kHz.

In order to permit adapting the frequency response of the loudspeaker within given limits to personal feeling, local conditions or the like, the auto-transformer may have a plurality of taps connectable, for example, by means of a switch selectively to the resistor. Moreover, the resistor or the capacitor or both may be adjustable.

Existing electrostatic loudspeakers can be improved by applying the invention. To this end the invention provides a series network comprising an auto-transformer, a resistor and a capacitor in the above-described circuit arrangement.

BRIEF DESCRIPTION OF THE DRAWING FIGURES

The invention will now be described with reference to a drawing, in which

FIG. 1*a* is a schematic representation of a known electrostatic loudspeaker without equalizing network, FIG. 1*b* is a graph of the absolute value of the impedance thereof as a function of the frequency, FIG. 1*c* illustrates the relative efficiency of the loudspeaker as shown in FIG. 1*a* as a function of the frequency, FIG. 2*a* is a schematic representation of a known electrostatic loudspeaker with a frequency-response equalizing network, FIG. 2*b* is a graph of the absolute value of the impedance thereof as a function of the frequency, FIG. 2*c* shows the relative efficiency of the loudspeaker of FIG. 2*a* as a function of the frequency, FIG. 3*a* is a schematic representation of an electrostatic loudspeaker embodying the invention, FIG. 3*b* is a graph of the absolute value of the impedance thereof as a function of the frequency, FIG. 3*c* is a graphical representation of the relative efficiency of the loudspeaker of FIG. 3*a* as a function of the frequency, FIG. 4 shows an auto-transformer with a plurality of taps and an equalizing network embodying the invention.

DETAILED DESCRIPTION OF THE INVENTION

FIG. 1*a* illustrates quite schematically an electrostatic loudspeaker system comprising a diaphragm 3, polarisable through bias terminals 1, 2 and arranged between two perforated, electrically conductive plates 4, 5, to which can be applied an audio signal originating from two input terminals 9, 10 through a transformer 6 having a primary winding 7, a secondary winding 8 and a central tap. The transformer 6 may have a transformation ratio of primary to secondary 1:60. Thus such an impedance transformation to the input terminals 9, 10 of the capacity between the plates 4, 5 takes place that a variation of the absolute value of the impedance with the frequency is obtained as is illustrated in FIG. 1*b*. The highest value of about 140 Ohm corresponds to the fundamental system resonance. The lowest value of about 2 Ohm lies in the range of the highest frequencies to be reproduced. Between the highest and lowest impedance values the impedance behaves purely reactively.

FIG. 1*c* shows the frequency response of the loudspeaker system shown in FIG. 1*a*. Clearly apparent is the rising tendency which is generally not desirable, as will be obvious, with regard to a sound reproduction true to nature.

FIG. 2*a* shows a known electrostatic loudspeaker system in which a frequency-response equalizing network comprising a resistor 11 and a capacitor 12 is arranged in the supply lead between the input terminal 10 and the primary winding 7. Without going into details reference is made to FIG. 2*b*, from which it will be apparent that the extreme values of the absolute impedance are even further apart than is indicated in FIG. 1*b* for the loudspeaker system of FIG. 1*a*. In particular, attention is drawn to the extraordinarily low value of less than 2 ohms occurring at the topmost frequencies. A further, extremely serious disadvantage of the configuration is that the efficiency is very low as compared with the efficiency of the loudspeaker shown in FIG. 1*a* as is indicated in FIG. 1*c*. For the curves of FIGS. 1*c* and 2*c* the same reference value of 0 dB is taken.

The time constant of the resistor 11 and the capacitor 12 has a value such that the transition point of said network lies, for example, at 80 Hz.

FIG. 3*a* shows an electrostatic loudspeaker system according to the invention. It comprises, apart from the aforesaid parts known from the prior art, an auto-transformer 13, one end terminal 14 is directly connected to the input 9, the other end terminal 15 through a capacitor 16 to the input 10 and the tap 17 through a resistor 18 to the input 10.

Reference is now made to the graphical representation of the absolute value of the impedance as a function of the frequency measured by a loudspeaker as shown in FIG. 36. It is apparent that the magnitudes of the absolute value of the impedance vary considerably less than is the case in the known technology. In this example, in which the reproducer itself has a capacity of about 2400 pF, the transformer has a transformation ratio of 1:60, the resistor 18 has a value of 8 Ohm and the capacitor 16 a value of 5 μF, the maximum value of the impedance is always lower than 70 Ohm, whilst the lowest value is more than 4 Ohm.

Reference is now made to FIG. 3*c*, from which it is clearly apparent that a straight frequency response is obtained, whilst with respect to the loudspeaker system of FIG. 2*a* the efficiency has improved by about 6 dB.

In the embodiment shown in FIG. 3*a*, a tap at half the overall winding is chosen. Other transformation ratios may be used, which will be discussed with reference to FIG. 4.

With respect to the operation of the loudspeaker of FIG. 3*a* it is noted that for lower frequencies the capacitor 16 may be considered to be absent so that to the primary winding 7 of the step-up transformer 6 is applied a voltage twice as high as the voltage prevailing between the end terminal 14 and the central tap 17. For higher frequencies capacitor 16 constitutes a short-circuit so that, so to say, the auto-transformer 13 is put out of operation. This strongly simplified argumentation is not intended to give a conclusive declaration of the excellent properties of the loudspeaker embodying the invention as found in practice. This is only meant to provide a base for a calculated good understanding of the invention.

FIG. 4 shows an auto-transformer 19 having three taps 20, 21, 22 connected to the corrresponding fixed contacts 23, 24, 25 of a switch 6 having a mother contact 27 connected to the resistor 18. It will be obvious that by a selection of the tap 21, 20 or 22 by means of the switch 26 a given adaptation of the frequency response of the loudspeaker can be obtained. This adaption relates to the lower frequencies.

The invention is not limited to the embodiments described above. For example, reference is made to the possibility of using a variable resistor 18 and/or a variable capacitor 16. Moreover, the auto-transformer may be provided with more taps or else with one tap, which does not correspond to the middle of the winding.

As a matter of fact, the use of loudspeakers as headphones is lying within the scope of the invention.

Finally, reference is made to the possibility of using electret systems, which do not require external bias voltage as applied to the terminals 1, 2 in the embodiments described herein.

I claim:

1. An electrostatic loudspeaker system comprising an electrostatic loudspeaker having an electrically polarized or polarisable diaphragm arranged between two perforated electrically conductive plates to which an audio signal covering a predetermined frequency range can be applied through two input terminals, a frequency-response equalizing network comprising a resistor, a capacitor and an autotransformer winding having opposite end terminals and at least one intermediate tap, one end terminal of which winding is directly connected to one of said input terminals, the other end terminal of which winding is connected through said capacitor to the other of said input terminals and the tap being connected through said resistor to said other input terminal and means connecting said end terminals of said autotransformer winding to said perforated electrically conductive plates for supplying a frequency response equalized audio signal to said plates so that the variation of input impedance of the electrostatic loudspeaker system over said predetermined frequency range is reduced.

2. A loudspeaker system as claimed in claim 1 characterized in that the resistor and the capacitor have in common a time constant of the order of magnitude of 40 μs.

3. A loudspeaker system as claimed in claim 1 or 2 characterized in that the auto-transformer has a plurality of taps selectively connectable to the resistor.

4. An electrostatic loudspeaker system as defined in claim 1 wherein said means comprises a transformer having a primary winding and a secondary winding, said primary winding being connected in parallel across said opposite end terminals of the autotransformer winding and said secondary winding being connected to said electrically conductive plates.

5. A loudspeaker system as claimed in claim 4 characterized in that the resistor and the capacitor have in common a time constant of the order of magnitude 40 μs.

6. A loudspeaker system as claimed in claim 4 characterized in that the autotransformer has a plurality of taps selectively connectable to the resistor.

7. A loudspeaker system as defined in claim 1 wherein one or both of said capacitor and said resistor are adjustable.

8. A loudspeaker system as defined in claim 2 wherein one or both of said capacitor and said resistor are adjustable.

9. A loudspeaker system as defined in claim 3 wherein one or both of said capacitor and said resistor are adjustable.

10. A loudspeaker system as defined in claim 4 wherein one or both of said capacitor and said resistor are adjustable.

11. A loudspeaker system as defined in claim 5 wherein one or both of said capacitor and said resistor are adjustable.

12. A loudspeaker system as defined in claim 6 wherein one or both of said capacitor and said resistor are adjustable.

13. In combination with an electrostatic loudspeaker having an electrically polarized or polarizable diaphragm arranged between two perforated electrically conductive plates and a transformer having a primary winding and a secondary winding in which said conductive plates of the loudspeaker are connected to said secondary winding, the improvement which comprises:

autotransformer means for energizing said primary winding from an audio input signal covering a predetermined range of frequencies such that the electrostatic loudspeaker system exhibits a reduced input impedance variation over said predetermined range of frequencies.

14. In the combination as defined in claim 13 wherein said autotransformer means comprises an autotransformer winding connected across said primary winding and having at least one intermediate tap, one end of said autotransformer winding being connected to the audio input signal through a capacitor while the other end of the autotransformer winding is connected directly to the audio input signal.

15. In the combination as defined in claim 14 wherein said autotransformer means also includes a resistor connecting said intermediate tap to the audio input signal.

16. In the combination as defined in claim 15 wherein said resistor and said capacitor are of values exhibiting an RC time constant of about 40 μsec.

17. In the combination as defined in claim 15 wherein said transformer has a transformation ratio of about 1:60.

18. In the combination as defined in claim 16 wherein said transformer has a transformation ratio of about 1:60.

19. An electrostatic loudspeaker system which comprises an electrostatic loudspeaker having a pair of input terminals, a transformer comprising a primary winding and a secondary winding, the ends of said secondary winding being connected to said pair of input terminals, an autotransformer winding connected in parallel with said primary winding and having at least one intermediate tap, a pair of audio signal input terminals adapted to receive an audio input signal covering a wide range of frequencies, one of said audio signal input terminals being connected with one end of said autotransformer winding and the other audio signal input terminal being connected through a resistor to said intermediate tap and to the other end of said autotransformer winding through a capacitor, whereby that portion of said autotransformer winding between said tap and said one end thereof tends to operate as a primary winding as the frequency of said audio signal decreases and the entire autotransformer winding tends to operate as a primary winding as the frequency of said audio signal increases.

20. An acoustic loudspeaker system as defined in claim 19 wherein said capacitor has a value of about five microfarads and said resistor has a value of about eight ohms.

21. An acoustic loudspeaker system as defined in claim 19 wherein said transformer has a turns ratio between its primary and secondary windings of about 1:60.

22. An electrostatic loudspeaker system which comprises an electrostatic loudspeaker having a pair of input terminals, an autotransformer winding having at least one intermediate tap and opposite ends, and means connecting the opposite ends of said winding to said pair of input terminals, a pair of audio signal input terminals adapted to receive an audio input signal covering a predetermined range of frequencies, one of said audio signal input terminals being connected with one end of said autotransformer winding and the other audio signal input terminal being connected through a resistor to said intermediate tap and to the other end of said autotransformer winding through a capacitor, whereby that portion of said autotransformer winding between said tap and said one end thereof tends to operate as a primary winding as the frequency of said audio signal decreases and the entire autotransformer winding tends to operate as a primary winding as the frequency of said audio signal increases to attain good efficiency of the electrostatic loudspeaker system over said predetermined range of frequencies while obtaining moderate variation in input impedance of the electrostatic loudspeaker system over said range of frequencies.

23. An electrostatic loudspeaker system as defined in claim 22 wherein said means comprises a transformer having a primary winding connected in parallel with said autotransformer winding and a secondary winding connected to said input terminals of the electrostatic loudspeaker.

* * * * *